US007448609B2

(12) United States Patent
Terashima et al.

(10) Patent No.: US 7,448,609 B2
(45) Date of Patent: Nov. 11, 2008

(54) SHEET FEEDING DEVICE

(75) Inventors: Hideyuki Terashima, Kawasaki (JP); Kazuyuki Morinaga, Kawasaki (JP); Akihiro Tomoda, Yokohama (JP); Hideaki Nagahara, Yokohama (JP); Naohiro Iwata, Yokohama (JP); Yoshiaki Suzuki, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/961,774

(22) Filed: Dec. 20, 2007

(65) Prior Publication Data

US 2008/0157459 A1 Jul. 3, 2008

(30) Foreign Application Priority Data

Dec. 28, 2006 (JP) ..... 2006-354009

(51) Int. Cl.
*B65H 3/44* (2006.01)
*B65H 5/26* (2006.01)

(52) U.S. Cl. ..... 271/9.08; 271/9.07; 271/9.11; 271/9.13; 271/162

(58) Field of Classification Search ..... 271/9.13, 271/9.07, 9.11, 9.09, 9.01, 162
See application file for complete search history.

(56) References Cited

U.S. PATENT DOCUMENTS 5,171,006 A * 12/1992 Naito ..... 271/9.09
5,391,009 A * 2/1995 Stodder ..... 400/605
6,029,970 A * 2/2000 Hwang ..... 271/9.08
6,227,533 B1 * 5/2001 Jang ..... 271/109
6,315,280 B1 * 11/2001 Jang ..... 271/9.02
6,929,414 B2 * 8/2005 Kadomatsu ..... 400/608.2
7,290,763 B2 * 11/2007 Suzuki et al. ..... 271/9.13
2005/0286942 A1 * 12/2005 Terashima et al. ..... 399/361

* cited by examiner

*Primary Examiner*—Patrick H Mackey
*Assistant Examiner*—Patrick D Cicchino
(74) *Attorney, Agent, or Firm*—Canon USA Inc I.P. Div

(57) ABSTRACT

A sheet feeding device includes a guiding member having an upper guiding surface for guiding the upper surface of a document and a lower guiding surface for guiding the lower surface of the document to guide the document to a support portion. The guiding member is movable to a set position for guiding the document to the support portion without causing the document to come into contact with a feeding roller, a recording-sheet separation position withdrawn for separating one sheet from the other recording sheets and feeding the separated sheet, a document separation position for guiding the document to the feeding roller, and a sheet return position for returning the recording sheet or the document to a corresponding support portion using a return lever. The guiding member is held via a spring such that the guiding member can be returned by itself from the sheet return position to the set position.

10 Claims, 11 Drawing Sheets

SHEET FEEDING DEVICE

BACKGROUND OF THE INVENTION

1. Field of the Invention

The present invention relates to a sheet feeding device suited for mounting on a recording apparatus, a reading apparatus, or an image reading and recording apparatus.

2. Description of the Related Art

Feeding devices are widely used as a unit that feeds a sheet to an image forming portion or a reading portion in apparatuses functioning as printers, copiers, and/or facsimile machines. A sheet feeding device is configured to separate one sheet from a sheet bundle of recording media, such as paper, cloth, plastic sheets, or transparencies, (hereinafter referred to as recording sheets) or reading media (hereinafter referred to as documents) and to feed the separated sheet to a processing portion, such as an image forming portion or a reading portion.

There is an image reading and recording apparatus that reduces the number of parts by using a feeding mechanism shared for recording sheets and documents to miniaturize the size of the apparatus and cut costs. In addition, U.S. patent application Publication No. 2005-0286942 discloses an image reading and recording apparatus that aims to reduce the size and costs by using a shared feeding device to separate one sheet from the other documents or recording sheets and to feed the separated sheet and a shared conveying mechanism to convey the fed sheet.

However, in the image reading and recording apparatus described in this patent document, a document supporting portion for supporting documents is disposed above a recording-sheet stacking portion for supporting recording sheets. Thus, it is necessary to set a bundle of documents on the document supporting portion such that the leading end of the documents is positioned adjacent to the peripheral surfaces of the feeding roller. For this reason, when a document curled upward is set or a document is roughly set by a user, the leading end of the document may come into contact with the feeding roller. This may cause an unstable set state of the document, thus resulting in a reduction in the separating and feeding abilities.

In the image reading and recording apparatus described in this patent document, the document supporting portion is disposed above the recording-sheet stacking portion. Thus, the lower surface of a document can be held and guided, whereas the upper surface of the document cannot be guided. In this arrangement, a space above the set documents is large. Thus, in the case of a thin document (e.g., a slip), the leading end of the thin document may be bent by its own weight and the bent document may be set. In this case, the separating and feeding abilities to transport the document may be reduced. The separating ability may also be reduced by undesirable bending of the leading end of a protruding document while being returned to a support portion by a return lever.

SUMMARY OF THE INVENTION

The present invention is directed to a sheet feeding device that is easy to set sheets at a support portion and has an excellent ability to separate and feed a sheet.

According to an aspect of the present invention, a sheet feeding device includes a first supporting portion, a second supporting portion, a feeding roller, a returning member, and a guiding member. The first supporting portion is configured to support a first sheet. The second supporting portion is configured to support a second sheet. The feeding roller is configured to feed the first sheet supported on the first supporting portion or the second sheet supported on the second supporting portion. The returning member is configured to return the first sheet or the second sheet to a corresponding supporting portion. The guiding member is disposed on the second supporting portion and is configured to guide the second sheet. The guiding member is movable to a set position when the second sheet is set on the second supporting portion, a second-sheet separation position when the second sheet supported on the second supporting portion is fed by the feeding roller, a first-sheet separation position when the first sheet supported on the first supporting portion is fed by the feeding roller, and a sheet return position when the first sheet or the second sheet is returned by the returning member.

Further features of the present invention will become apparent from the following description of exemplary embodiments (with reference to the attached drawings).

DESCRIPTION OF THE EMBODIMENTS

Figure 1:
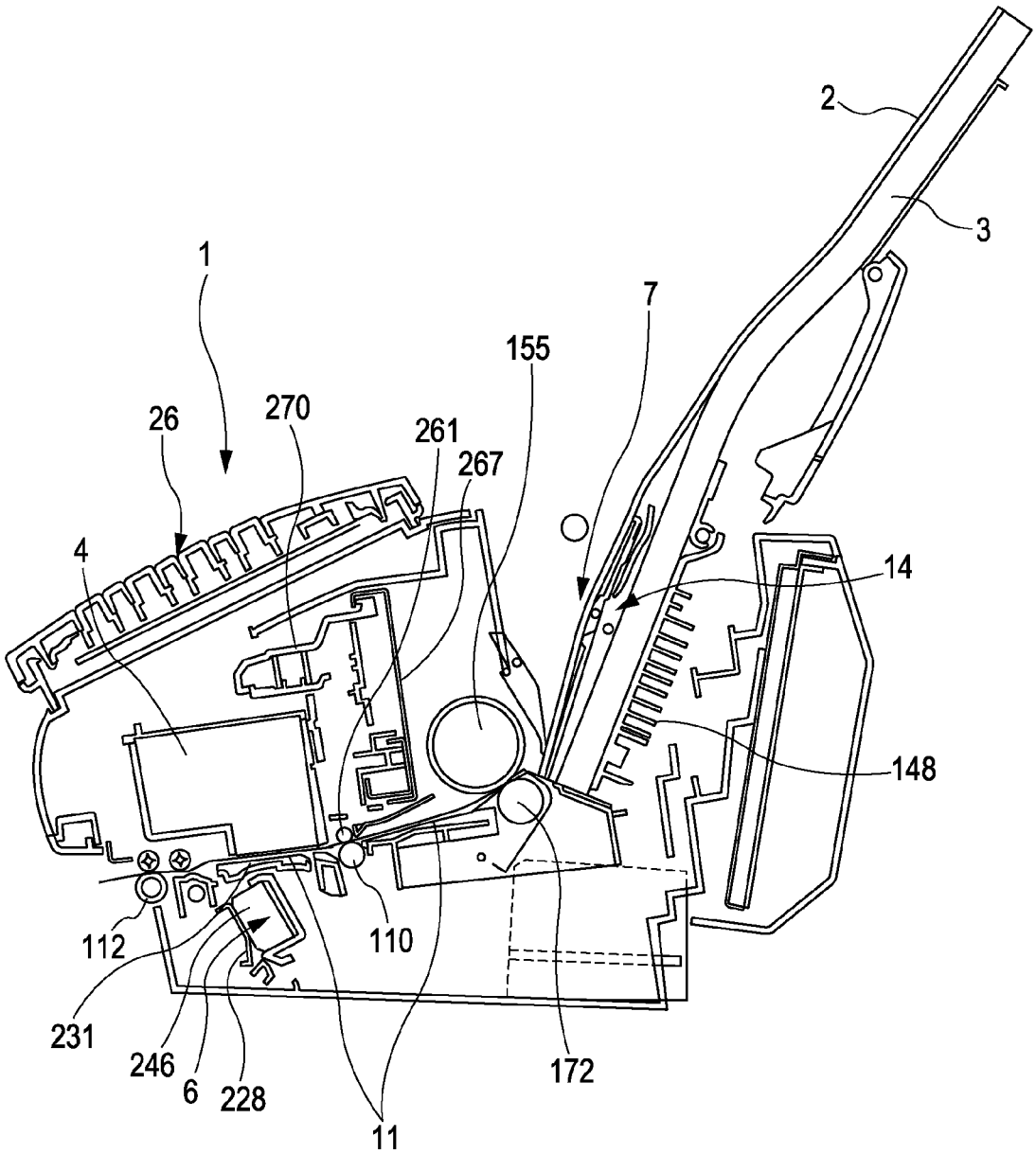
FIG. 1 is a vertical sectional view that illustrates a general structure of an image reading and recording apparatus according to an embodiment of the present invention.
Figure 2:
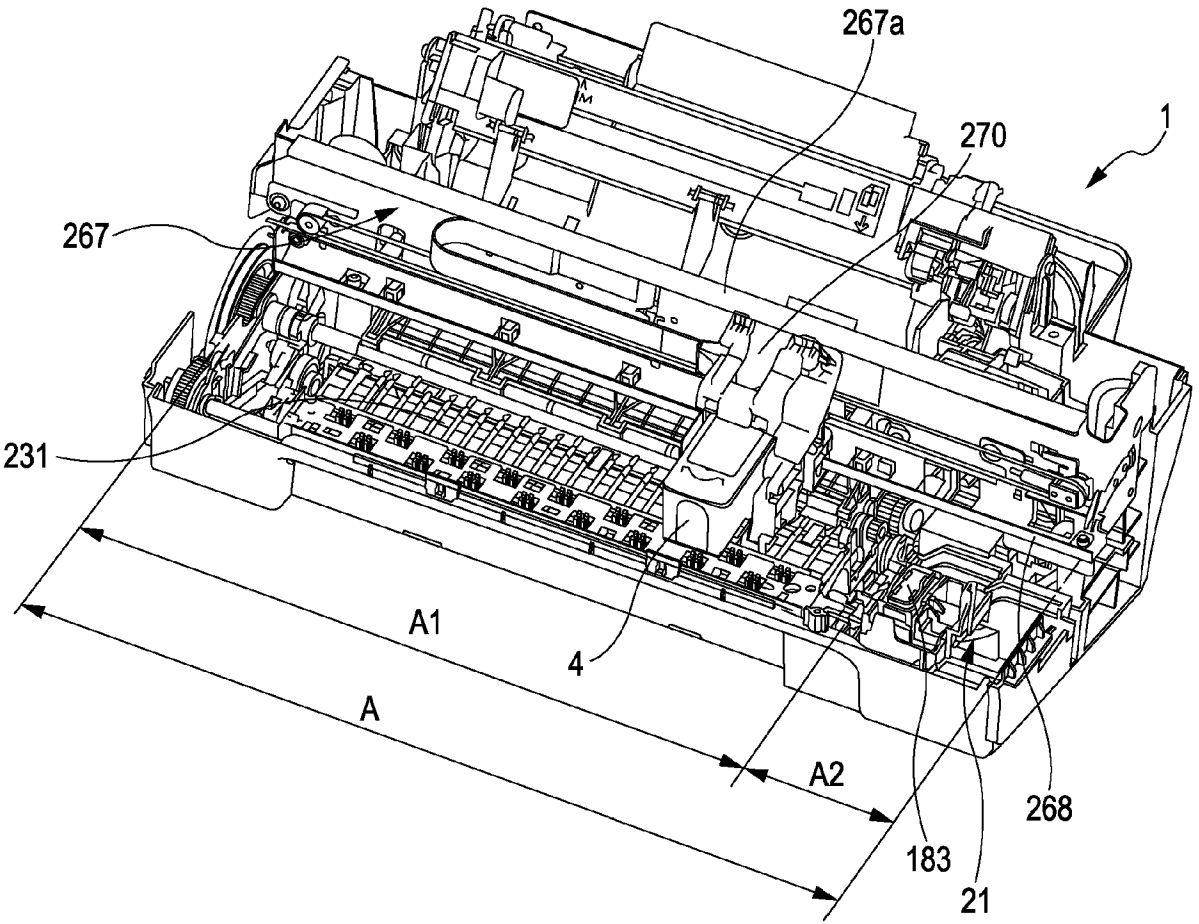
FIG. 2 is a perspective view of the image reading and recording apparatus.
Figure 3:
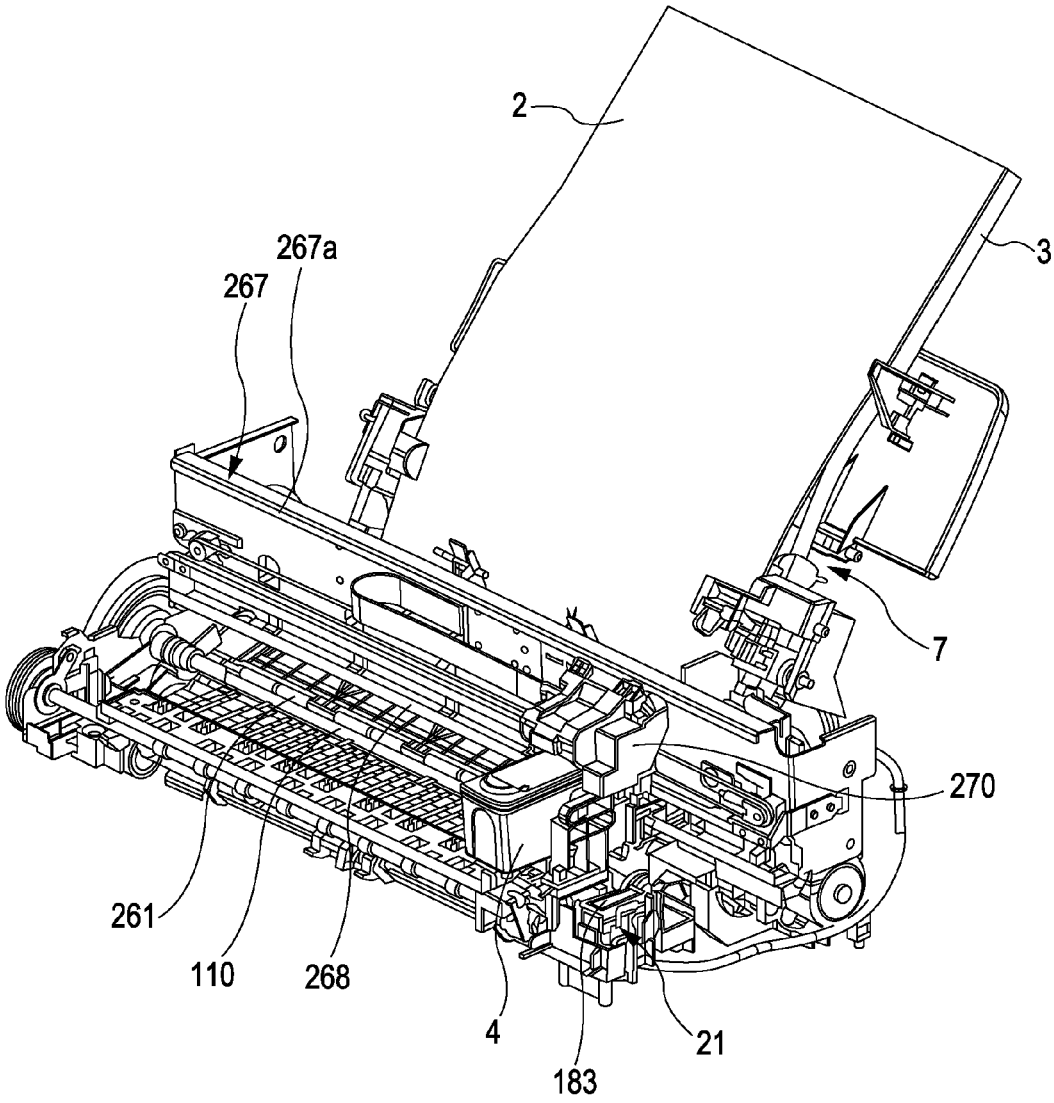
FIG. 3 is another perspective view of the image reading and recording apparatus.

Embodiments of the present invention are specifically described with reference to the accompanying drawings, in which like reference characters designate the same or corresponding parts throughout the figures thereof. FIG. 1 is a vertical sectional view that illustrates a general structure of an image reading and recording apparatus 1 according to an embodiment of the present invention. FIG. 2 is a perspective view of the image reading and recording apparatus. FIG. 3 is another perspective view of the image reading and recording apparatus. Referring to FIGS. 1 to 3, the image reading and recording apparatus 1 includes a recording head 4 mounted on a carriage 270, a reading unit 6 configured to read a document, a sheet feeding device 7 configured to supply a recording sheet or a document, a conveying unit including a conveying roller 110 for conveying the recording sheet or the document, and an ejecting unit including an ejecting roller 112 for ejecting a recording sheet or a document. The recording head 4 can be an ink jet recording head, which discharges ink onto a recording sheet to record information.

A sheet stacking portion 14 has a support portion for supporting one or more recording sheets 3 (first sheets) and a support portion for supporting one or more documents 2 (second sheets). In the present invention, both a recording sheet and a document or either one is referred to as a sheet. A feeding roller 155, disposed in the sheet feeding device 7, can separate one sheet from the other supported recording sheets 3 or documents 2 and feed the separated sheet. The recording sheet 3 separated by the feeding roller 155 is fed to a conveying path 11 adjacent to the conveying roller 110.

The sheet separated by the feeding roller 155 is conveyed by the conveying roller 110 and a pinch roller 261 pressed into contact with the conveying roller 110. The recorded or read sheet is ejected from the apparatus main body by the ejecting roller 112.

The carriage 270 is held such that the carriage 270 can reciprocate along a chassis rail 268 and a support rail 267*a* formed in part of a chassis 267 in a direction orthogonal to the direction of conveying sheets. The chassis rail 268 and the chassis 267 horizontally extend. A platen 231 is disposed so as to face the recording head 4 mounted on the carriage 270. In the present embodiment, the platen 231 is moved to above the conveying path 11 during a reading operation of reading the document 2 and is moved to a use position as illustrated in FIG. 1 during a recording operation of recording information on the recording sheet 3. The recording sheet 3 recorded by discharging of ink from the recording head 4 is ejected from the apparatus main body by the conveying roller 110 and the ejecting roller 112. The ejected recording sheet 3 is placed on a tray or other similar receptacle.

As illustrated in FIG. 2, a discharge recovering portion 21 is disposed within a moving range of the carriage 270 and at the right-hand side in the drawing outside a recording area where recording is performed on a recording sheet. The discharge recovering portion 21 is a device for recovering the ability of the recording head 4 to discharge ink and maintaining it at a normal state. In FIG. 2, a region A represents a range where the carriage 270 is movable (carriage movable range). A first region A1 represents a range where the carriage 270 is moved in a cap-open state in which a cap 183 is separated from the recording head 4. A second region A2 represents a range where the carriage 270 is moved in a cap-closed state (capping state) in which the cap 183 is in contact with the recording head 4.

Figure 4:
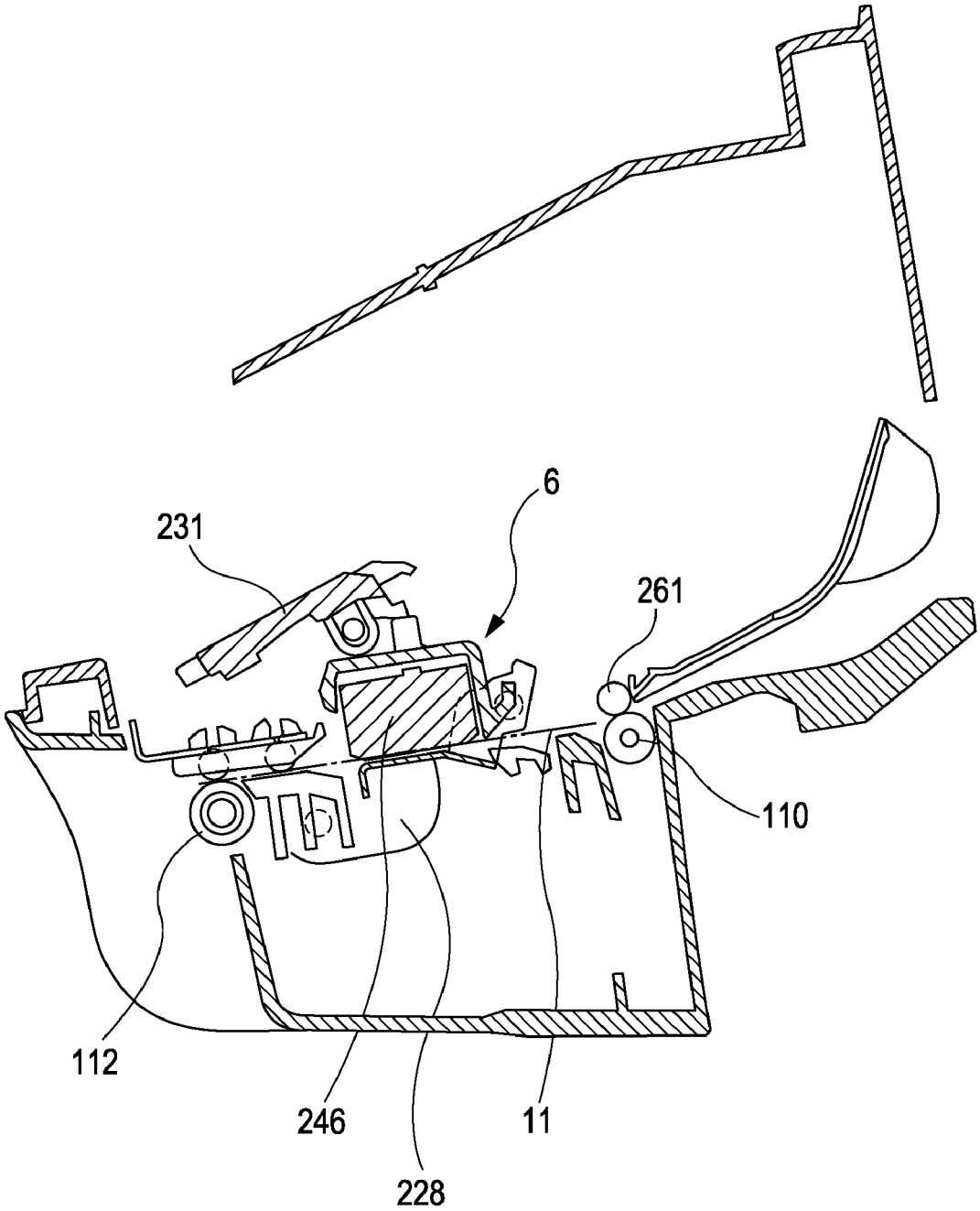
FIG. 4 is a vertical sectional view that illustrates a reading unit and its surroundings during a reading operation.
Figure 5:
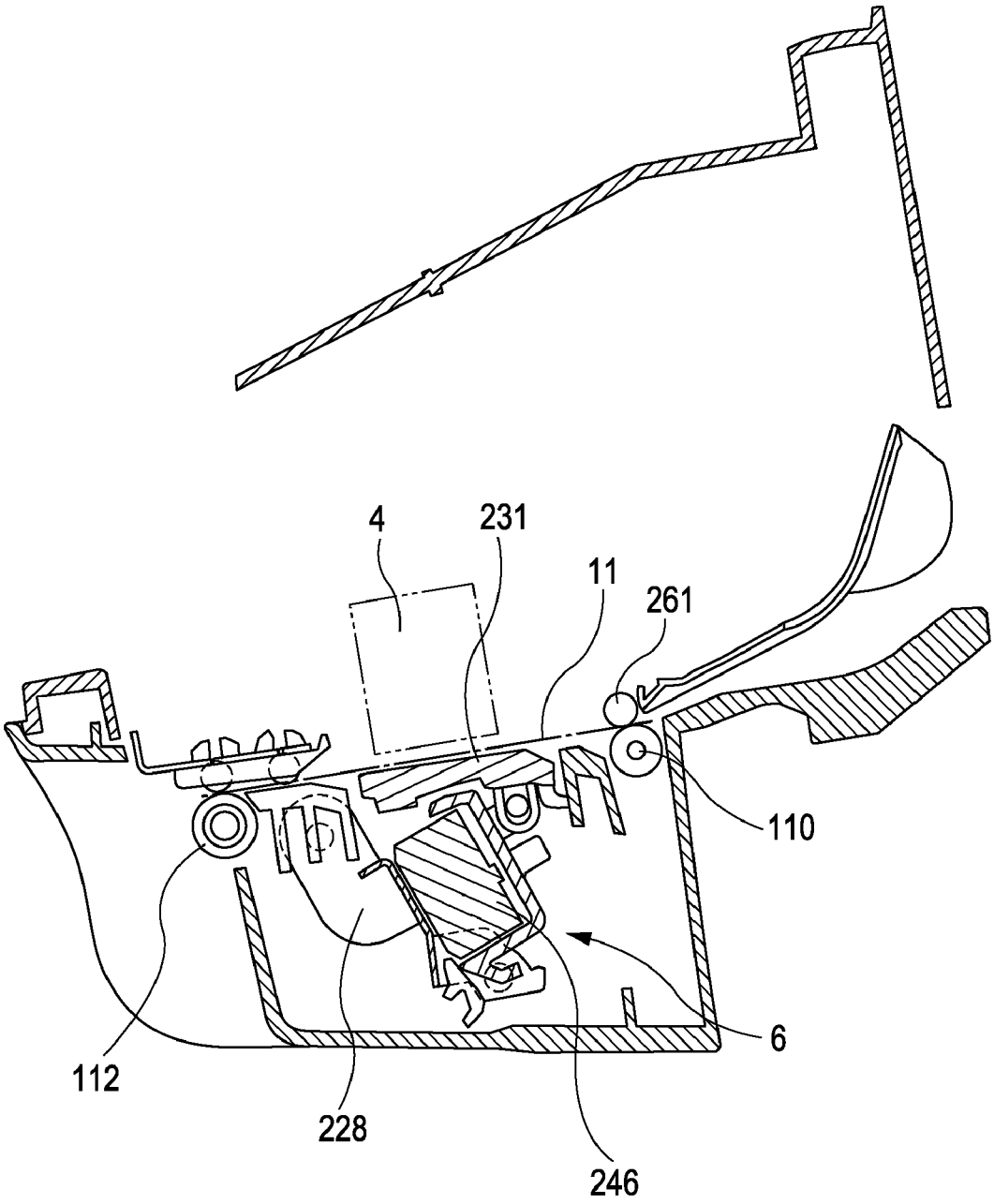
FIG. 5 is a vertical sectional view that illustrates the reading unit and its surroundings during a recording operation.

FIG. 4 is a vertical sectional view that illustrates the reading unit 6 and its surroundings during a reading operation. FIG. 5 is a vertical sectional view that illustrates the reading unit 6 and its surroundings during a recording operation. During a standby state in which neither a recording operation nor a reading operation is performed, the reading unit 6 configured to read the document 2 is maintained at a state illustrated in FIG. 4. When an instruction to start recording is issued in response to an operation of an operating panel 26 in a standby state illustrated in FIG. 4, the reading unit 6 is moved to an evacuate position below the conveying path 11, and the platen 231 is moved to the use position (FIG. 5) below the conveying path 11.

After the recording operation is completed, the reading unit 6 is moved from below to above the conveying path 11 and is brought into a reading state illustrated in FIG. 4 (equal to the standby state). Together with this movement of the reading unit 6, the platen 231 is moved above the conveying path 11. When the reading unit 6 is situated above the conveying path 11 or is moving, the carriage 270 is situated at a withdrawn position outside a sheet conveying region at the right-hand side in the apparatus illustrated in FIG. 2. Thus, the carriage 270 does not interfere with the reading unit 6.

A reading operation will now be described below. As illustrated in FIG. 4, during a standby state of the image reading and recording apparatus 1, the reading unit 6 is situated above the conveying path 11. When an instruction to read an image is issued in response to an operation of the operating panel 26 performed by a user or other similar action, one or more documents 2 placed on the sheet stacking portion 14 are separated from the others by the feeding roller 155, and the separate document is fed to the conveying roller 110. The fed document 2 is read by the reading unit 6 while being conveyed along the conveying path 11 by the conveying roller 110 and the ejecting roller 112. The reading unit 6 includes a read sensor 246 and a white reference member 228. After the completion of the reading operation, the document 2 is ejected from the apparatus main body via the ejecting roller 112.

Figure 6:
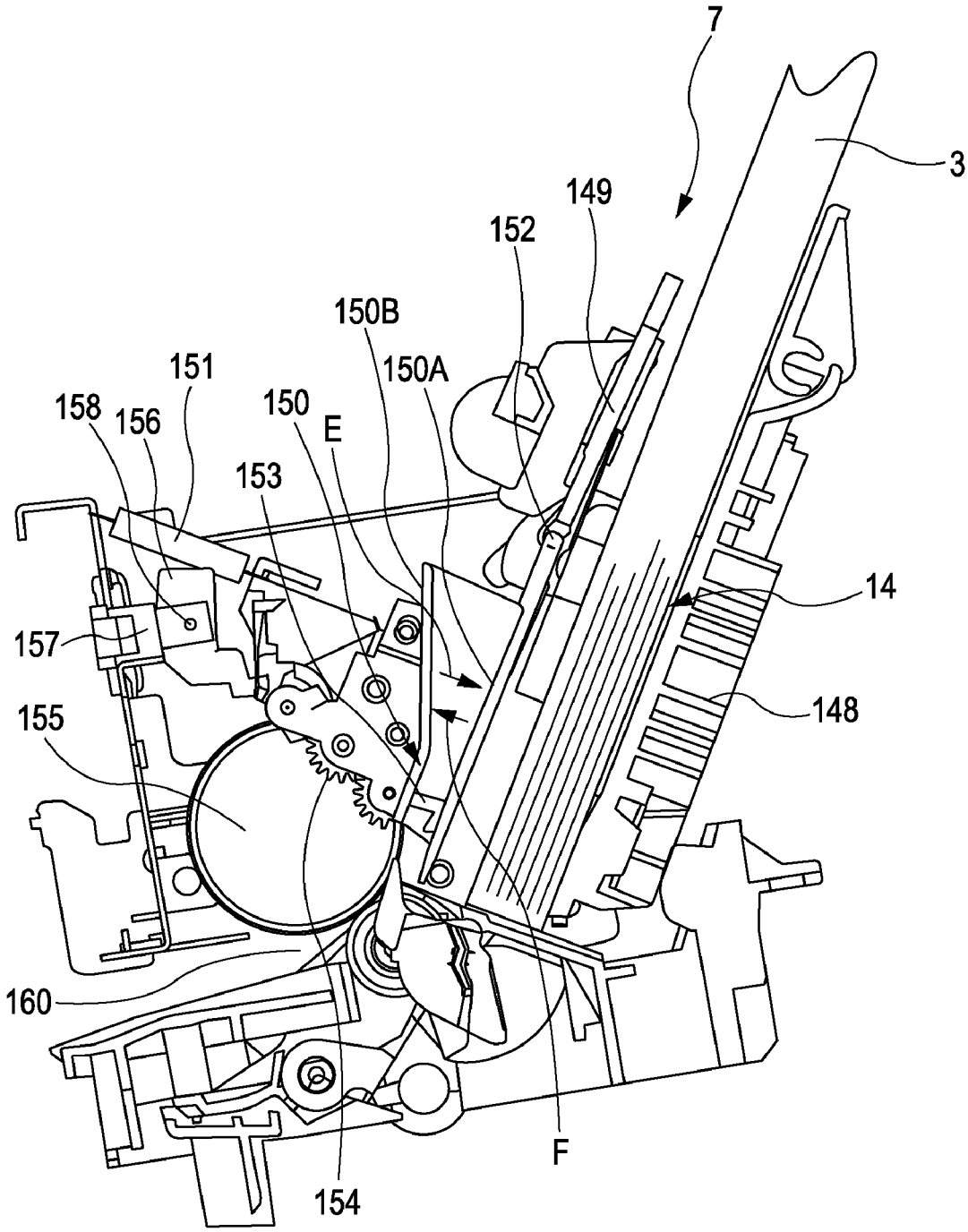
FIG. 6 is a vertical sectional view that illustrates a state in which recording sheets are set in a sheet feeding device.

FIG. 6 is a vertical sectional view that illustrates a state in which the recording sheets 3 are set in the sheet feeding device 7. In FIG. 6, an original plate 149 is fixed on the apparatus main body above a pressure plate 148 with a space for allowing a plurality of recording sheets 3 to be set therebetween. The support portion for the recording sheets 3 is provided on the upper surface of the pressure plate 148. A guiding member 150 configured to guide one or more documents 2 to a support portion therefor is held on the original plate 149 so as to be pivotable via a pivot 152. The original plate 149 and the guiding member 150 form the support portion for the documents 2. The guiding member 150 includes a lower guiding surface 150A for guiding the lower surface of the documents 2 and an upper guiding surface 150B for guiding the upper surface of the documents 2. Between the lower guiding surface 150A and the upper guiding surface 150B, a clearance for allowing the documents 2 to be set therebetween is present. This clearance is minimized to hold a flimsy document, so the clearance is set at a dimension of the thickness of the maximal settable sheets with a little allowance added. In the present embodiment, in consideration of curling of a document, the clearance has, for example, an allowance of approximately 2 mm for the thickness of a bundle of documents.

The guiding member 150 is held by a spring 151 that is actuated (expanded) under a load larger than a load produced by the weight of the guiding member 150 and the weight of supported documents. The position of the guiding member 150 in a pivoting direction is regulated. That is, the guiding member 150 is pivoted in a direction indicated by the arrow E when an external force exerted in the direction of the arrow E exceeds the initial tension of the spring 151 (a load produced by the weight of the guiding member 150 and the weight of the document). When the external force becomes equal to or smaller than the initial tension, the guiding member 150 is returned to the initial position by itself. In the case of an external force exerted in a direction indicated by the arrow F, when the external force exceeds the initial tension, the guiding member 150 is pivoted. When the external force becomes equal to or smaller than the initial tension, the guiding member 150 is returned to the initial position by itself. The position of the upper guiding surface 150B in a state in which the spring 151 is not actuated (initial state) is set at a position at which the upper guiding surface 150B can guide a document without causing the leading end of the document to be caught by the peripheral surface of the feeding roller 155 while the document is set. In the present embodiment, the peripheral surface of the feeding roller 155 is flush with the upper guiding surface 150B. However, the upper guiding surface 150B may be disposed outside or a little inside the peripheral surface of the feeding roller 155.

The guiding member 150 holds a sheet contact member 153. The sheet contact member 153 is rotatable by the leading end of the document 2 (second sheet) coming into contact therewith when the document 2 is supported. As will be described below, the movement of the sheet contact member 153 can produce a detection signal indicating the presence of a document. That is, the sheet contact member 153 is disposed at a position at which the sheet contact member 153 can be rotated by being contacted by the leading end of the document 2 set at the support portion. By use of the position of the sheet contact member 153, not only the presence or absence of a document but also whether the document can be fed or not can be detected. More specifically, the sheet contact member 153 is coupled to a blocking member 156 via a transmission mechanism 154 composed of a gear train so as to be rotatable in synchronization with the blocking member 156.

When the leading end of the document is not in contact with the sheet contact member 153, the blocking member 156 blocks an optical axis 158 for a photosensor 157 (a detection-signal producing portion). When the leading end of the document comes into contact with the sheet contact member 153, the rotation of the sheet contact member 153 is transmitted to the blocking member 156, and the blocking member 156 is rotated. This releases the blocking of the optical axis 158, thus enabling the photosensor 157 to detect the presence of a document. The sheet contact member 153 is retained by the elastic force of a spring to enable detection of the presence of even a fragile document having a thickness on the order of 60 μm by being rotated by contacting with the leading end of the document. In the present embodiment, the sheet contact member 153 is retained by the spring. However, the sheet contact member 153 may be retained by a torque produced by the weight of the blocking member 156 or the weight of the sheet contact member 153.

Figure 7:
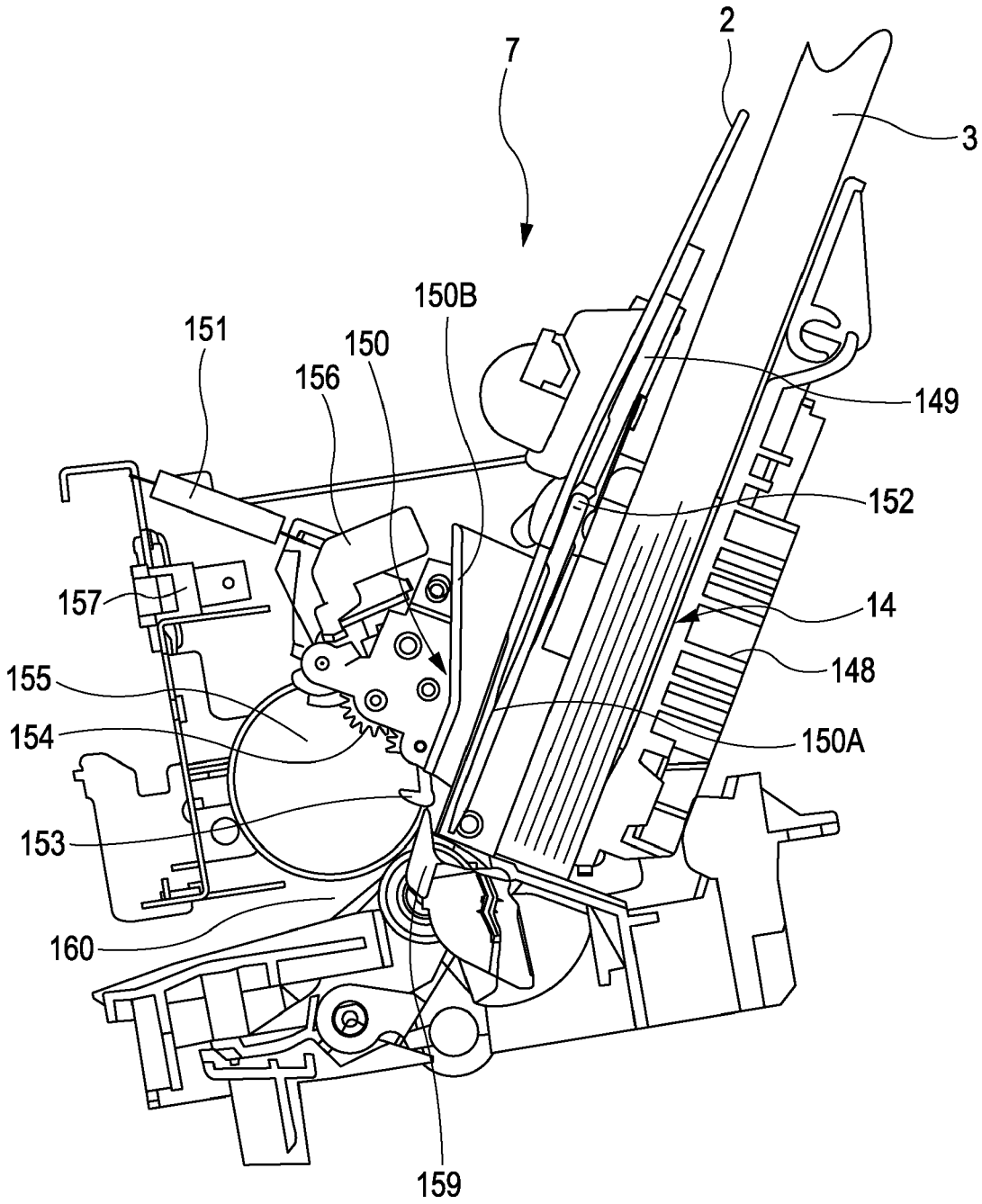
FIG. 7 is a vertical sectional view that illustrates a state in which recording sheets and documents are set in the sheet feeding device.
Figure 8:
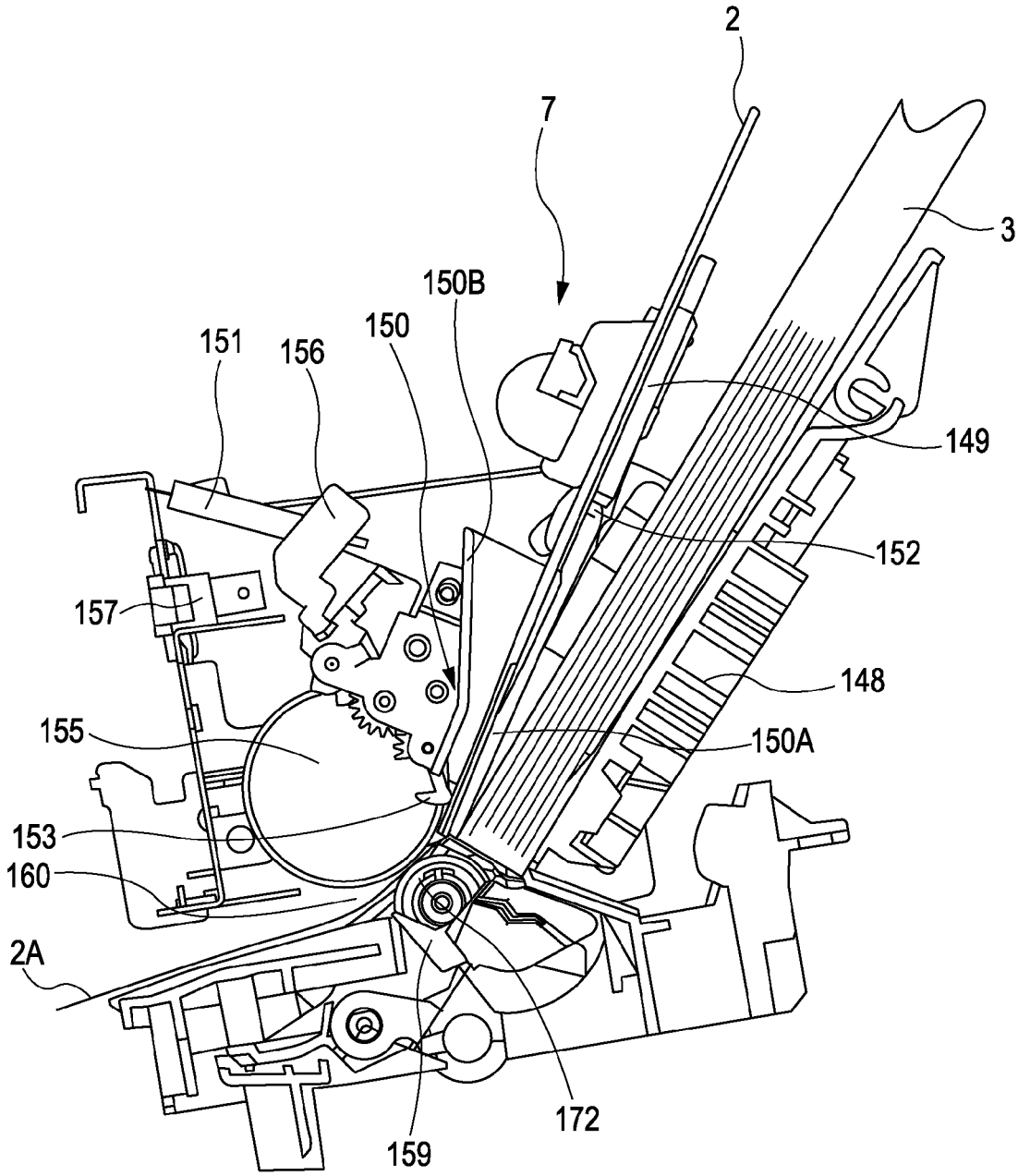
FIG. 8 is a vertical sectional view that illustrates a state in which a single document is separated from the other documents in the sheet feeding device.
Figure 9:
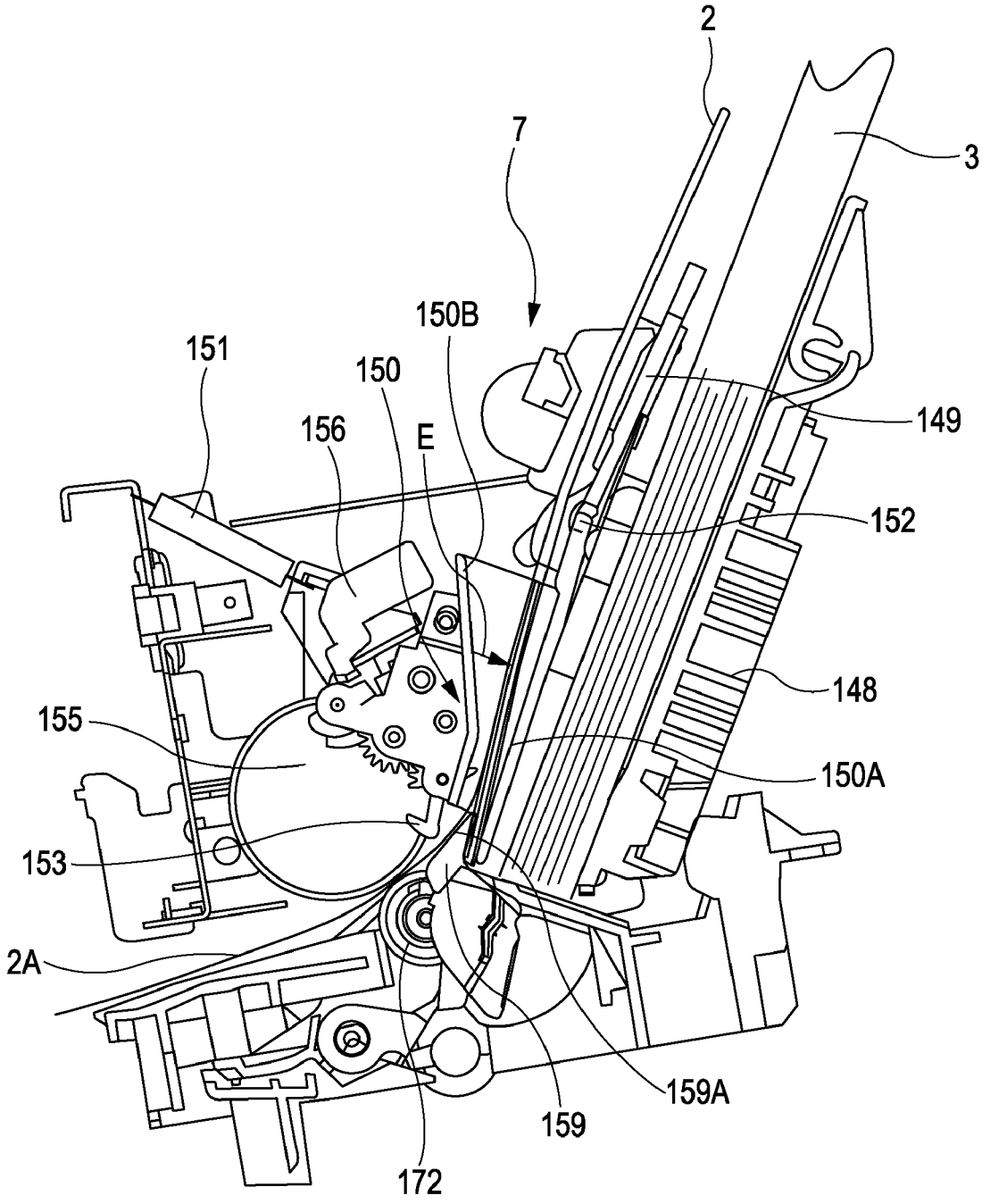
FIG. 9 is a vertical sectional view that illustrates a state in which a returning member is moved to an evacuate position after the single document is separated from the other documents in the sheet feeding device.

A feeding operation of a plurality of documents 2 in the sheet feeding device 7 will now be described below. FIG. 7 is a vertical sectional view that illustrates a state in which recording sheets 3 and documents 2 are set in the sheet feeding device 7. FIG. 8 is a vertical sectional view that illustrates a state in which a single document is separated from the other documents 2 in the sheet feeding device 7. FIG. 9 is a vertical sectional view that illustrates a state in which a returning member is moved to an evacuate position after the single document is separated from the other documents 2 in the sheet feeding device 7.

In FIG. 7, the plurality of documents 2 set at the support portion formed by the original plate 149 and the guiding member 150 has been guided between the upper guiding surface 150B and the lower guiding surface 150A of the guiding member 150. After the documents 2 are set, the leading end thereof pivots the sheet contact member 153, and the photosensor 157 detects the presence of the documents 2. At this time, although the guiding member 150 receives a load of the weight of the documents 2, the guiding member 150 is retained at the initial position by the initial tension of the spring 151. The initial position is a set position at which the documents 2 are set at the support portion and in a standby state for a reading operation. When the guiding member 150 is situated at this set position, the documents 2 have been guided by the guiding member 150 at the support portion shown in the drawing so as not to come into contact with the feeding roller 155. At this set position, the documents 2 and the recording sheets 3 accommodated in the sheet stacking portion 14 are prevented from falling to a separation portion 160 by a return lever 159 (returning member). The position of the return lever 159 illustrated in FIG. 7 is a set position thereof.

How a single document is separated from the other will now be described below with reference to FIG. 8. First, the documents and the recording sheets are brought into a separable state by rotation of the return lever 159 in a counterclockwise direction in the drawing from the state illustrated in FIG. 7 to a withdrawn position. The position of the return lever 159 illustrated in FIG. 8 is a separated position thereof. When the pressure plate 148 rises via a cam mechanism at a predetermined timing, the plurality of documents 2 are pressed against the feeding roller 155 with the recording sheets 3 sandwiched therebetween. The guiding member 150 is also raised by the rising pressure plate 148 via the recording sheets 3. The guiding member 150 is pivoted about the pivot 152 clockwise in the drawing, thus guiding the plurality of documents 2 to the feeding roller 155 and being pivoted to a document separation position (second-sheet separation position) at which the documents are separable. The document separation position of the guiding member 150 illustrated in FIG. 8 is higher than the set position illustrated FIG. 7.

When the feeding roller 155 is driven so as to be rotated in this state, the documents 2 are transported to the separation portion 160 by the feeding roller 155 and a separation roller 172. Subsequently, only one uppermost document is separated from the plurality of documents 2 by a nip defined between the feeding roller 155 and the separation roller 172, and the separated document is fed to the downstream conveying roller 110. The guiding member 150 pivotally retained on the original plate 149 can be returned by itself from the document separation position (second-sheet separation position) illustrated in FIG. 8 to the set position illustrated in FIG. 7 by resiliency of the spring 151 in an expansion direction, the spring 151 having been compressed from the position for the initial tension. Alternatively, the guiding member 150 can be returned by itself by its own weight.

How the single separated document is fed will now be described below with reference to FIG. 9. After the separation of the document 2 is completed, the pressure plate 148 is returned at a predetermined timing to a set position at which pressing is released. At the same time, the return lever 159 is rotated clockwise in the drawing, and the rotation of the return lever 159 returns a document remaining at the nip defined between the feeding roller 155 and the separation roller 172 to the support portion. At this time, the return lever 159 is rotated clockwise in the drawing while the leading end of the return lever 159 slides on the back side of a single separated document 2A, and is rotated up to a position that does not interfere with the conveying path of the document 2A. The position where the return lever 159 does not interfere with the document being fed illustrated in FIG. 9 is an evacuate position for the return lever 159.

When the return lever 159 is rotated to the evacuate position illustrated in FIG. 9, the return lever 159 presses the documents 2 on the support portion downward, and the guiding member 150 is pressed downward via the documents 2. The guiding member 150 is pivoted counterclockwise about the pivot 152 on the original plate 149 by being pressed downward by the return lever 159, and is pivoted up to a sheet return position illustrated in FIG. 9. This sheet return position of the guiding member 150 is also a position for enabling a return operation of the return lever 159. This sheet return position of the guiding member 150 is a position where the guiding member 150 situated at the set position (initial position) illustrated in FIG. 7 is pivoted counterclockwise in the drawing about the pivot 152. Therefore, a load exceeding the initial tension in the direction of the arrow E is exerted on the spring 151, so the spring 151 is in an expanded state (a state in which the spring 151 can be returned by itself by release of the load). The single separated document 2A is fed while passing through a gap formed between the upper guiding surface 150B and a back (rear) surface 159A of the return lever 159.

The fed document is read by the reading unit 6 while being conveyed by the conveying roller 110, and is then ejected from the apparatus main body by the ejecting roller 112. After the rear end of the document 2 is moved out of the feeding roller 155 or the reading operation is completed, the return lever 159 is pivoted counterclockwise in the drawing and brought into a standby state illustrated in FIG. 7. At the same time, the guiding member 150 is released from the pressing force of the return lever 159, and is returned by itself from the sheet return position illustrated in FIG. 9 to the set position illustrated in FIG. 7 by the elastic force of the spring 151.

Figure 10:
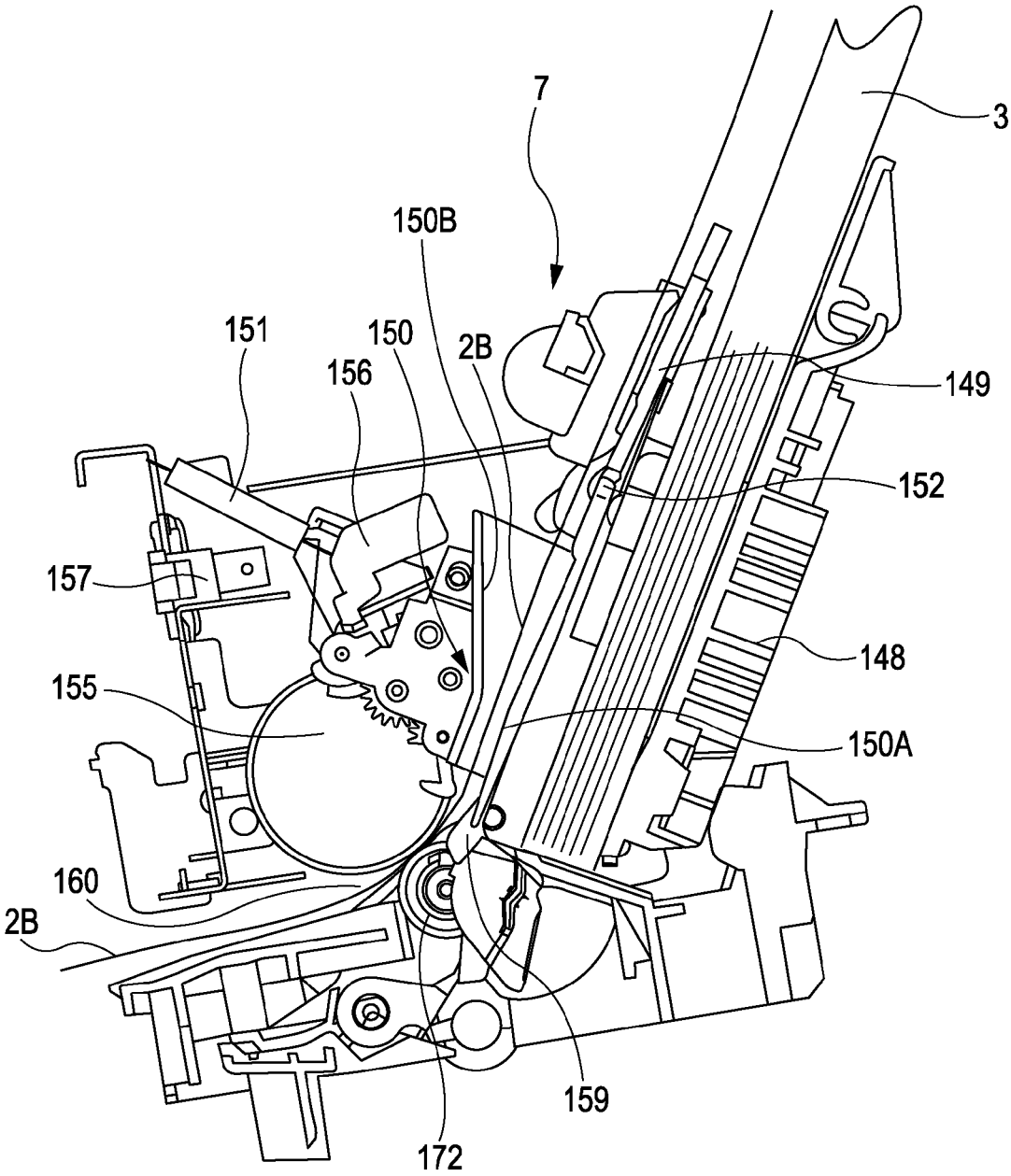
FIG. 10 is a vertical sectional view that illustrates a state in which the returning member is moved to an evacuate position when only a single set document is separated and fed in the sheet feeding device.

FIG. 10 is a vertical sectional view that illustrates a state in which the return lever 159 is moved to an evacuate position when only a single set document is separated and fed in the sheet feeding device 7. In FIG. 10, the pressure plate 148 has been returned to a set position at which pressuring is released, as in the case of in FIG. 9. The guiding member 150 and the return lever 159 are situated at different positions separated from each other in the sheet width direction. Thus, for separation and feeding of only a single set document 2B, the return lever 159 and the guiding member 150 do not interfere with each other even when the return lever 159 is rotated to an evacuate position. Therefore, as illustrated in FIG. 10, the return lever 159 is rotated up to a position at which the return lever 159 overlaps the guiding member 150 and brought into an evacuate state. The guiding member 150 is not pressed downward by the return lever 159 and is retained at the set position (initial position) illustrated in FIG. 7.

At this time, a gap is present between the upper guiding surface 150B of the guiding member 150 and the document being separated and fed. Therefore, when the return lever 159 is moved from the separation position illustrated in FIG. 8 to the evacuate position illustrated in FIG. 10 while sliding on the back side of the document 2B, the document can escape upward. This can prevent a document from being deformed by the return lever 159 even when the document is thin, and thus can reduce poor feeding, such as jamming.

Figure 11:
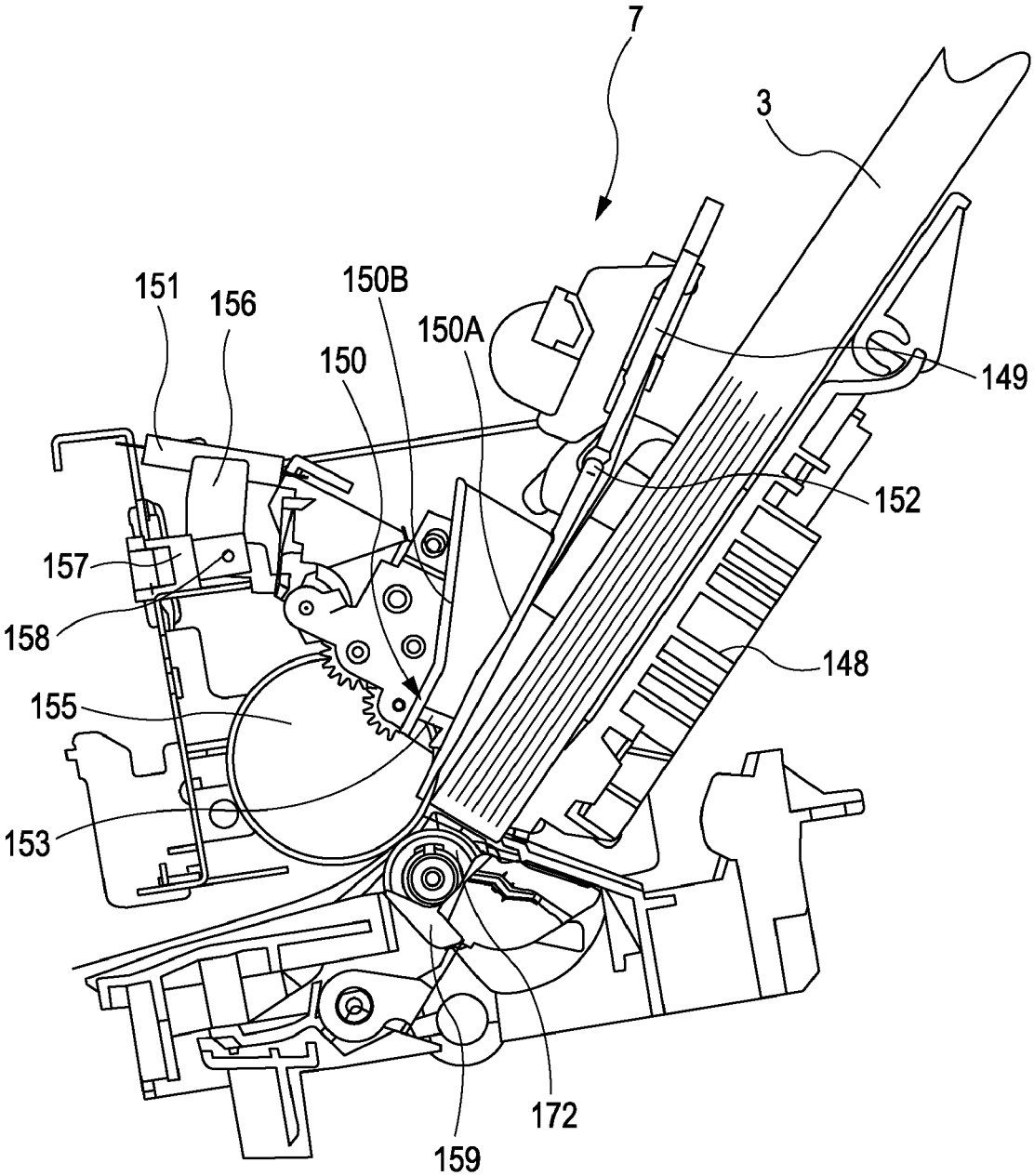
FIG. 11 is a vertical sectional view that illustrates a state in which a recording sheet is separated in the sheet feeding device.

A feeding operation for a recording sheet will now be described below. FIG. 11 is a vertical sectional view that illustrates a state in which recording sheets 3 are separated one from the other in the sheet feeding device 7. In FIG. 11, first, the return lever 159 is rotated counterclockwise in the drawing up to an illustrated evacuate position (open position), and the recording sheets 3 (the first sheets) are brought into a state in which they can be separated and fed. The pressure plate 148 is raised by a cam mechanism at a predetermined timing, and the recording sheets 3 are pressed against the feeding roller 155.

The guiding member 150 is pressed upward by the rising pressure plate 148 via the recording sheets 3, and is then pivoted clockwise about the pivot 152 and raised up to a position illustrated in FIG. 11. This position of the guiding member 150 is a first-sheet separation position (recording-sheet separation position) at which the guiding member 150 is withdrawn to allow the recording sheets 3 (the first sheets) to be separated from the others and be fed. This recording-sheet separation of the position guiding member 150 is a position where the guiding member 150 situated at the document separation position illustrated in FIG. 8 is further pivoted. At this time, although the blocking member 156 is pivoted about the pivot 152 integrally with the guiding member 150, the optical axis 158 for the photosensor 157 is still blocked by the blocking member 156. Thus, the photosensor 157 detects that a document is not present.

When the feeding roller 155 is driven so as to be rotated in this state, the recording sheets 3 pressed against the feeding roller 155 are transported between the separation portion 160 formed by the feeding roller 155 and the separation roller 172. Subsequently, only the uppermost recording sheet is separated from the recording sheets 3 by the nip defined between the feeding roller 155 and the separation roller 172, and the separated sheet is conveyed in the feed direction. After that, as in the case of the document, the return lever 159 returns the remaining recording sheets to the support portion while being rotated clockwise in the drawing. Then, the return lever 159 is rotated counterclockwise in the drawing and returned to the illustrated evacuate position. The lower surface (bottom surface) of the guiding member 150 is held by the single separated recording sheet, so the guiding member 150 is retained at the illustrated recording-sheet separation position. When the rear end of the recording sheet 3 is moved out of the nip defined between the feeding roller 155 and the separation roller 172, the guiding member 150 is returned by itself to the set position (initial position) illustrated in FIG. 7 by its own weight. That is, the guiding member 150 is returned by itself to the set position illustrated in FIG. 7 by resiliency of the spring 151 in an expansion direction, the spring 151 having been compressed from the position for the initial tension.

In the present embodiment, the guiding member 150 is rotated by its own weight while being returned by itself from the recording-sheet separation position illustrated in FIG. 11 or the document separation position illustrated in FIG. 8 to the set position illustrated in FIG. 7. However, an urging unit for causing the guiding member 150 to return by itself may be provided. The spring 151 may be used as this urging unit.

According to the above described embodiment, the sheet feeding device supports one or more documents above one or more recording sheets such that the documents overlie the recording sheets. The sheet feeding device separates one sheet from the other documents or the other recording sheets and feeds the separated sheet using a single feeding roller. The sheet feeding device includes the guiding member 150 having the upper guiding surface 150B for guiding the upper surface of the supported documents 2 and the lower guiding surface 150A for guiding the lower surface of the supported documents 2. The guiding member 150 can be situated at at least four positions: the recording-sheet separation position, the document separation position, the set position (initial position), and the sheet return position. In the present embodiment, the guiding member 150 is pivoted about the pivot 152. However, the guiding member 150 may be translated upward and downward.

The structure described above can prevent unstable setting caused by a state in which the leading end of a document comes into contact with the surface of the feeding roller while the document is being set at the support portion. This can prevent a decrease in the feeding ability. In addition, this can prevent the document from buckling caused by coming into contact with the surface of the feeding roller. By use of the guiding member 150, both the upper and lower surfaces of a document can be guided within a predetermined space. This can prevent a thin document from being bent by its own weight while the document is being set or separated and fed. This can prevent a decrease in the feeding ability resulting from such a bend. As a result, there is provided a sheet feeding device that is easy to set sheets at a support portion and has an excellent ability to separate and feed a sheet.

The above embodiment has described separating and feeding of a recording sheet being a first sheet and a document being a second sheet by way of example. However, the present invention is applicable to separating and feeding of a recording sheet and a recording sheet or of a document and a document.

According to the embodiment of the present invention, a sheet feeding device is provided that is easy to set sheets at a support portion and has an excellent ability to separate and feed a sheet.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2006-354009 filed Dec. 28, 2006, which is hereby incorporated by reference herein in its entirety.

What is claimed is:

1. A sheet feeding device comprising:

a first supporting portion configured to support a first sheet;

a second supporting portion configured to support a second sheet;

a feeding roller configured to feed the first sheet supported on the first supporting portion or the second sheet supported on the second supporting portion;

a returning member configured to return the first sheet or the second sheet to a corresponding supporting portion; and a guiding member disposed on the second supporting portion and configured to guide the second sheet, the guiding member being movable to a set position when the second sheet is set on the second supporting portion, a second-sheet separation position when the second sheet supported on the second supporting portion is fed by the feeding roller, a first-sheet separation position when the first sheet supported on the first supporting portion is fed by the feeding roller, and a sheet return position when the first sheet or the second sheet is returned by the returning member.

2. The sheet feeding device according to claim 1, further comprising an urging unit holding the guiding member, wherein the guiding member is moved to the set position in an initial state.

3. The sheet feeding device according to claim 2, wherein the guiding member is moved by the urging unit from the sheet return position to the set position.

4. The sheet feeding device according to claim 1, wherein the sheet return position, the set position, the second-sheet separation position, and the first-sheet separation position of the guiding member are arranged in this order from bottom.

5. The sheet feeding device according to claim 1, wherein the guiding member holds a sheet contact member moved when contacted by the second sheet, and the guiding member detects whether the second sheet is supported by movement of the sheet contact member.

6. The sheet feeding device according to claim 3, further comprising an urging unit configured to move the guiding member situated at the second-sheet separation position or the first-sheet separation position to the set position.

7. The sheet feeding device according to claim 6, wherein the urging unit configured to move the guiding member situated at the second-sheet separation position or the first-sheet separation position to the set position is the same as an urging unit configured to move the guiding member situated at the sheet return position to the set position.

8. The sheet feeding device according to claim 1, wherein the first sheet is a recording sheet, and recording is performed on the first sheet fed by the feeding roller using a recording head.

9. The sheet feeding device according to claim 8, wherein the recording head is an ink jet recording head, which discharges ink to record information.

10. The sheet feeding device according to claim 1, further comprising a reading unit configured to read an image of the second sheet fed by the feeding roller, wherein the second sheet is a document.

* * * * *